United States Patent [19]

Tajima et al.

[11] Patent Number: 4,727,526

[45] Date of Patent: Feb. 23, 1988

[54] ALARM ON-OFF MECHANISM FOR ALARM WATCH

[75] Inventors: Yukio Tajima; Keiichi Yoshizawa; Nobuhiro Tanaka, all of Tokyo, Japan

[73] Assignee: Seikosha Co., Ltd., Tokyo, Japan

[21] Appl. No.: 940,515

[22] Filed: Dec. 10, 1986

[30] Foreign Application Priority Data

Dec. 24, 1985 [JP] Japan ..... 60-198705[U]

[51] Int. Cl.[4] ..... G04B 29/00

[52] U.S. Cl. ..... 368/319; 368/308; 368/74

[58] Field of Search ..... 368/306, 307, 308, 319, 368/320, 321, 264, 265, 266, 262, 263, 74, 257

[56] References Cited

U.S. PATENT DOCUMENTS

| | | | |
|---|---|---|---|
| 579,996 | 4/1897 | Mink | 368/307 |
| 3,418,800 | 12/1968 | Hashi | 368/319 |
| 3,877,217 | 4/1975 | Hochstrate | 368/320 |
| 4,430,532 | 2/1984 | Matsumoto | 368/320 |

FOREIGN PATENT DOCUMENTS

| | | | |
|---|---|---|---|
| 621664 | 2/1981 | Switzerland | 368/320 |

*Primary Examiner*—Bernard Roskoski

*Attorney, Agent, or Firm*—Bruce L. Adams; Van C. Wilks

[57] ABSTRACT

An alarm on-off mechanism for an alarm watch is provided wherein two alarm push-pieces are symmetrically provided on opposite sides of the watch case. An alarm lever is interlocked with the alarm push-pieces in such a manner that the alarm is turned on by pressing one of the alarm push-pieces and the alarm is turned off by pressing the other alarm push-piece.

7 Claims, 6 Drawing Figures

ALARM ON-OFF MECHANISM FOR ALARM WATCH

BACKGROUND OF THE INVENTION

1. Field of the Invention

The present invention relates generally to an alarm watch, and in particular to an "analog" alarm watch.

2. Background Information

In a conventional analog alarm watch, an alarm push-piece is also used as a hand-setting button or is provided separately from a hand-setting button. In either case, the on or off state of an alarm is selected by one of two states in which alarm push-pieces are pushed in, as shown by the solid lines in FIG. 6, described hereinafter, or pulled out, as shown by the broken lines in the same drawing.

The above-described conventional watch suffers a problem in that the stems of its alarm push-pieces are formed as cylinders owing to the necessity of providing water-proofing packing thereon, and if the stems are rotated by mistake, an alarm lever engaged with the ends of the stems is damaged.

SUMMARY OF THE INVENTION

One object of the present invention is to provide a device capable of solving the problem of conventional alarm watches, and comprises integrally combined rotation-preventing stems and cylindrical stems provided as the stems of the alarm push-pieces, the rotation-preventing stems preventing the rotation of the alarm push-pieces and the cylindrical stems being provided with water-proofing packing.

DESCRIPTION OF THE PREFERRED EMBODIMENT

Figure 1:
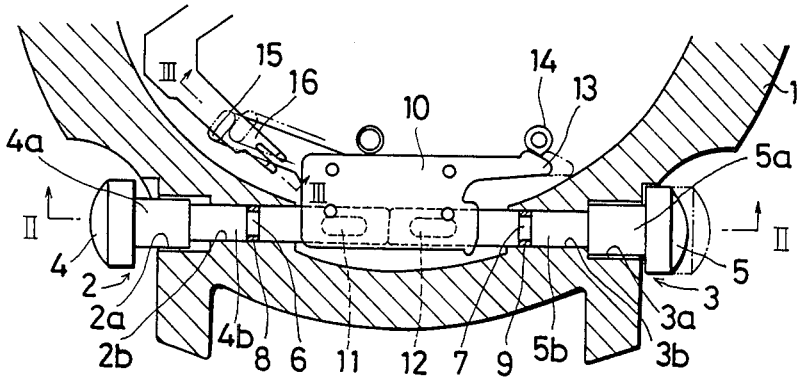
FIG. 1 is a sectional view through an embodiment of the present invention.
Figure 2:
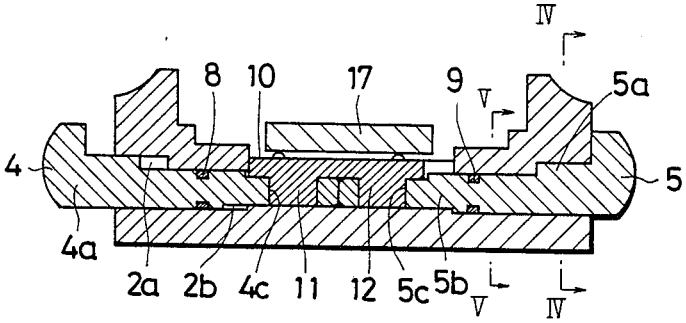
FIG. 2 is a sectional view taken along the line II—II in FIG. 1.
Figure 3:
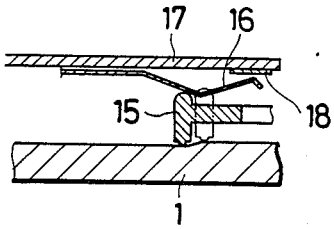
FIG. 3 is a sectional view taken along the line III—III in FIG. 1.
Figure 4:
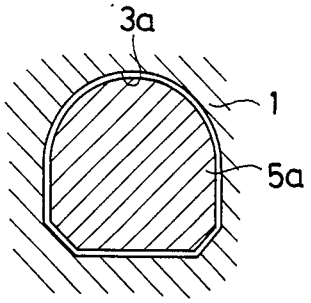
FIG. 4 is a sectional view taken along the line IV—IV in FIG. 2.
Figure 5:
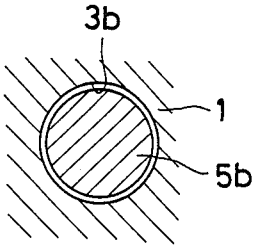
FIG. 5 is a sectional view taken along the line V—V in FIG. 2.
Figure 6:
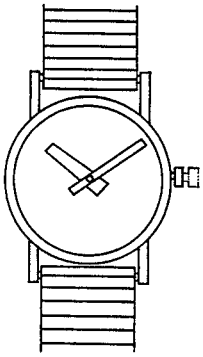
FIG. 6 is a plan view of a conventional alarm watch.

In FIGS. 1 to 3, the case 1 of a watch has channels 2, 3 which are symmetrically formed in positions near where the watch strap is connected to the case, and rotation-preventing holes 2*a*, 3*a* and cylindrical holes 2*b*, 3*b* are provided in the corresponding channels 2, 3 as part of each respective channel. Alarm push-pieces 4, 5 are respectively inserted into the channels 2, 3. The rotation-preventing stems 4*a*, 5*a* of the alarm push-pieces 4, 5 are respectively engaged in the rotation-preventing holes 2*a*, 3*a*, and cylindrical stems 4*b*, 5*b* thereof are respectively engaged in the cylindrical holes 2*b*, 3*b*. The stems 4*a*, 5*a* have non-circular sections, as shown in FIG. 4; although the upper portions thereof are round, the lower portions thereof are formed to be rectangular or square. Therefore, the alarm push-pieces 4, 5 can move axially but cannot rotate. The cylindrical stems 4*b*, 5*b* have circular sections, as shown in FIG. 5, and are respectively provided with circular grooves 6, 7 formed therein, packing pieces 8, 9 being inserted in the these grooves to provide a waterproof structure. Elliptical holes 4*c*, 5*c* are formed at the ends of the inner alarm push-pieces 4, 5, respectively. An alarm lever 10 is provided with pins 11, 12 which engage with the holes 4*c*, 5*c*, respectively. Therefore, the alarm push-pieces 4, 5 and the alarm lever 10 move in unison. A click piece 13 is formed on the alarm lever 10, and comprises a click mechanism 13, 14 in combination with a pin 14 which is provided on the case 1. An operating portion 15 of the alarm lever 10 brings an alarm-stopping contact piece 16 into contact on a conductor 18 provided with a base plate 17, and separates it therefrom responsive to movement of the alarm lever 10. In other words, the alarm-stopping contact piece 16 is separated from the conductor 18 when the mechanism is in the state shown by solid lines in FIGS. 1 and 3, in which the alarm is turned off or stopped. If the alarm push-piece 4 on the left side is pressed in, the alarm lever 10 moves to the right, and the operating portion 15 moves to the position shown by broken lines in FIGS. 1 and 3, so that the alarm-stopping contact piece 16 is pushed upward and is brought into contact with the conductor 18. This is the on state of the alarm.

In the above-described embodiment, the alarm push-pieces are symmetrically provided in the case, but a single push-piece can be utilized in a similar manner.

In the device of the invention, the alarm push-pieces of an alarm watch are prevented from rotating if an attempt is made to rotate them by mistake, so potential problems concerning damage to the alarm lever are obviated.

What is claimed is:

1. An alarm on-off mechanism for an alarm watch comprising: multiple symmetrically opposed physically interconnected alarm push-pieces symmetrically provided in a watch case and axially movable in symmetrically opposed channels, first portions of said alarm push-pieces and corresponding portions of said channels formed in a rotation-preventing configuration including push-piece stems having non-circular sections, second portions of said push-pieces having cylindrical stems slidingly engaging corresponding cylindrical portions of said symmetrically opposed channels, said cylindrical stems being provided with circular grooves in which waterproofing packing is provided, and an alarm contact piece actuated by an alarm lever, said alarm lever physically interconnecting said alarm push-pieces and said alarm contact piece so that said alarm push-pieces, said alarm contact piece, and said alarm lever move in unison.

2. An alarm mechanism according to claim 1; wherein axial movement of one of said alarm push-pieces engages said alarm contact piece and a conductor and axial movement of another of said alarm push-pieces disengages said alarm contact piece and said conductor.

3. An alarm mechanism according to claim 1; wherein said alarm lever has an operating portion forming a part thereof, said operating portion abutting said alarm contact piece to engage and disengage said contact piece from a conductor responsive to alternating axial movements of said alarm push-pieces.

4. An alarm mechanism according to claim 1; wherein said alarm is turned on by pressing one of said alarm push-pieces and said alarm is turned off by pressing another of said alarm push-pieces.

5. An alarm mechanism according to claim 1; wherein elliptical holes are provided in the stems of said alarm push-pieces, and corresponding pins are provided on said alarm lever engaging said elliptical holes to engagingly connect said alarm lever to said push-pieces, said alarm lever also having a click piece formed thereof which together with a pin mounted on said watch case comprises a click mechanism for said alarm watch.

6. Alarm on-off actuation means for an alarm watch comprising: axially aligned multiple alarm push-piece means for engaging and disengaging an alarm, said push-piece means symmetrically provided on opposite sides of a watch case, said multiple alarm push-piece means being axially movable in opposing relationship in a channel provided in said watch case, multiple portions of said channel being axially aligned and having different physical configurations, first portions of said alarm push-piece means and their corresponding channel portions being formed in a rotation-preventing non-circular section, second portions of said alarm push-piece means having cylindrical stems slidingly engaging cylindrical portions of said channels, alarm lever means for actuating said alarm, said alarm lever means physically interconnecting said multiple alarm push-piece means, and an alarm contact operated by an operating portion of said interconnecting alarm lever means in response to alternating axial movements of said alarm push-piece means, to thereby engage and disengage said alarm.

7. An alarm mechanism for a timepiece comprising a timepiece case, two axially aligned alarm push-pieces which are slidably mounted in the case and are interconnected for movement together in unison by an alarm lever having an alarm operating portion which is disposed within said case and which engages and disengages an alarm contact piece, the push-pieces having stems which are provided with first rotation-preventing non-circular sections having manually operable heads and second circular sections interconnected by said alarm lever, the arrangement being such that the alarm contact piece is movable into an operable position by pressing in one of the alarm push-pieces and is movable into an inoperable position by pressing in the other alarm push-piece.

* * * * *